US006681679B2

(12) United States Patent
Vives et al.

(10) Patent No.: US 6,681,679 B2
(45) Date of Patent: Jan. 27, 2004

(54) WALL PROTECTING DEVICE

(75) Inventors: Michel Vives, Saint Ambroix (FR); Alain Kerdraon, Bourges (FR); Jean-Paul Duparc, Bourges (FR)

(73) Assignee: Giat Industries, Versailles (FR)

( * ) Notice: Subject to any disclaimer, the term of this patent is extended or adjusted under 35 U.S.C. 154(b) by 6 days.

(21) Appl. No.: 09/914,775

(22) PCT Filed: Feb. 9, 2001

(86) PCT No.: PCT/FR01/00376

§ 371 (c)(1),
(2), (4) Date: Sep. 5, 2001

(87) PCT Pub. No.: WO01/59396

PCT Pub. Date: Aug. 16, 2001

(65) Prior Publication Data

US 2003/0164087 A1 Sep. 4, 2003

(30) Foreign Application Priority Data

Feb. 10, 2000 (FR) ..... 00 01684

(51) Int. Cl.[7] ..... F41H 11/00

(52) U.S. Cl. ..... 89/36.17; 89/36.01; 89/36.02; 89/36.13; 102/474; 102/402; 102/403

(58) Field of Search ..... 89/36.17, 36.02, 89/36.01, 36.13; 102/474, 402, 403, 494, 495

(56) References Cited

U.S. PATENT DOCUMENTS

| | | | | | |
|---|---|---|---|---|---|
| 2,110,322 A | * | 3/1938 | Calzavara | ..... | 89/36.02 |
| 3,081,704 A | * | 3/1963 | Boswell | ..... | 102/474 |
| 3,696,751 A | * | 10/1972 | Kempton | ..... | 102/474 |
| 3,893,368 A | * | 7/1975 | Wales, Jr. | ..... | 89/36.17 |
| 3,977,327 A | * | 8/1976 | Brumfield et al. | ..... | 102/494 |
| 4,216,720 A | * | 8/1980 | Kempton | ..... | 102/494 |

(List continued on next page.)

FOREIGN PATENT DOCUMENTS

| | | | | | |
|---|---|---|---|---|---|
| DE | 20 53 345 A1 | | 2/1977 | | |
| DE | 41 22 622 A1 | | 1/1993 | | |
| DE | 42 26 897 C1 | | 1/1998 | | |
| DE | 196 40 991 A1 | | 4/1998 | | |
| DE | 198 25 260 A1 | | 12/1999 | | |
| EP | 379080 | * | 7/1990 | ..... | 89/36.17 |
| EP | 0 922 924 A1 | | 6/1999 | | |
| GB | 2192697 A | * | 1/1988 | ..... | 89/36.01 |
| GB | 2231129 A | * | 11/1990 | ..... | 89/36.17 |
| GB | 2284878 A | * | 6/1995 | ..... | 89/36.17 |
| JP | WO 91/12483 | * | 8/1991 | ..... | 89/36.02 |

*Primary Examiner*—Michael J. Carone
*Assistant Examiner*—Lulit Semunegus
(74) *Attorney, Agent, or Firm*—Oliff & Berridge, PLC

(57) ABSTRACT

The invention relates to a wall (2)-protection device (1), notably for a vehicle wall, against attack by a projectile.

This device comprises at least one explosive charge (3) able to project at least one metallic block (7) in the direction of the projectile. The device is characterized in that the block or blocks (7) are in the shape of elongated bars, that is which have a maximal length greater than or equal to 10 times their smallest crosswise dimension, the explosive charge (3) being position opposite a longitudinal surface of the bar (7).

17 Claims, 7 Drawing Sheets

U.S. PATENT DOCUMENTS 4,368,660 A * 1/1983 Held ..... 89/36.17
4,741,244 A * 5/1988 Ratner et al. ..... 89/36.17
4,822,657 A * 4/1989 Simpson ..... 89/36.17
4,869,152 A * 9/1989 Marlow et al. ..... 89/36.02
4,879,165 A * 11/1989 Smith ..... 89/36.02
4,881,448 A * 11/1989 Medin et al. ..... 89/36.02
4,989,493 A * 2/1991 Blommer et al. ..... 89/36.17
5,012,721 A * 5/1991 Medin et al. ..... 89/36.17
5,025,707 A * 6/1991 Gonzalez ..... 89/36.17
5,070,764 A * 12/1991 Shevach et al. ..... 89/36.17
5,293,806 A * 3/1994 Gonzalez ..... 89/36.03
5,370,034 A * 12/1994 Turner et al. ..... 89/36.02
5,413,027 A * 5/1995 Mixon ..... 89/36.17
5,600,084 A * 2/1997 Gonzalez ..... 89/36.02
5,637,824 A * 6/1997 Benyami ..... 89/36.17
5,811,712 A * 9/1998 Held ..... 89/36.17
5,922,986 A * 7/1999 Wanninger et al. ..... 89/36.02
6,327,955 B1 * 12/2001 Kerdraon et al. ..... 89/36.17
6,474,213 B1 * 11/2002 Walker et al. ..... 89/36.17

* cited by examiner

WALL PROTECTING DEVICE

BACKGROUND OF THE INVENTION

The technical scope of the invention is that of devices providing protection for a vehicle wall against attack by a projectile.

Vehicles have seen their protective means develop over the years to enable them to better withstand a threat. The most conventional form of protection is constituted by passive armor made of metal or else of several layers of composite materials.

So-called reactive armor is also known comprising a layer of explosive placed between two metallic plates. The explosive of this armor is ignited by the impact of an incident projectile. The detonation of the explosive causes the metallic plate to be projected outwards towards the projectile, thereby destabilizing and/or destroying it. The latter type of armor is more particularly adapted to protection from shaped charges and fin-stabilized projectiles.

So as to make the protection even more effective, so-called active armor is currently being designed. This type of armor incorporates a threat attack module coupled with threat detection means, for example radar or infrared. When an incident projectile has been detected, the attack module is activated and projects a plate or metallic block or else splinters onto the incident projectile.

Patent EP922924 describes such an active armor that comprises a plurality of launchers allowing one or several metallic blocks to be projected onto a fin-stabilized projectile. Projection is ensured by explosive or else by a propellant charge. The projection rate is between 100 and 500 m/s.

The main drawback to this device lies in that the projected projectiles are cylindrical or parallelepipedic blocks having a relatively reduced ratio of their total length to their smallest crosswise dimension (of between around 1 and 5).

This results in a low incident projectile interception probability by the projected block. Such a device thus requires the use of very efficient detection means allowing the incident projectile to be located quickly and accurately.

Moreover, the projection rate for these blocks is relatively low thereby requiring the protection to be triggered at a reduced distance from the incident projectile, once again obliging the detection means to be very efficient.

Lengthening the blocks so as to make bars may be envisaged, however the problem is posed of projecting such bars when faced with a threat whilst reducing the strain on the bar as much as possible.

Indeed, if the bar is strained through the effect of the explosive when being projected, such a strain is not reproducible and this results in a reduction in the interception capabilities.

SUMMARY OF THE INVENTION

The aim of the invention is to propose a protection device that does not suffer from such drawbacks.

Thus, the protection device according to the invention is of improved effectiveness as it allows the probability of intercepting an incident projectile to be increased while ensuring the reproducibility of the performances.

Thus, the invention relates to a wall-protection device, notably for a vehicle wall, against attack by a projectile and comprising at least one explosive charge able to project at least one metallic block in the direction of the projectile, the device wherein the block or blocks are in the shape of elongated bars, that is, which have a maximal length greater than or equal to 10 times their smallest crosswise dimension, the explosive charge being position opposite a longitudinal surface of the bar. The bar can be parallelepipedic, for example with a rectangular cross-section.

According to an essential characteristic of the invention, the explosive charge can be ignited by priming means that will be placed at one end of the bar.

The device can incorporate a support having a bottom plate intended to be fastened to the wall and onto which the explosive charge is placed.

The support can incorporate a longitudinal cavity delimited by two lateral cheeks and accommodating the explosive charge and the bar or bars.

According to a particular embodiment, the device can incorporate at least two bars placed substantially in the prolongation of one another in the same support.

According to another embodiment, the device can incorporate at least two bars placed substantially in parallel to one another in the same support.

According to a variant, the device can incorporate three bars placed substantially in parallel to one another in the same support.

According to another variant, the device can incorporate at least one intermediate layer of a material having a specific sound impedance of the same magnitude as that of the bars, said intermediate layer being placed between the explosive charge and the bars. The intermediate layer can comprise a copper sheet of a thickness of 0.5 to 1 mm.

According to another embodiment, the support can be placed in a case. A layer of shock-absorbing material can be placed between the support and the case. The layer of shock-absorbing material can notably be placed between the case and the bottom and two lateral faces of the support. The shock-absorbing material comprises a material having a high volume compressibility modulus.

The shock-absorbing material will thus be selected from among the following materials: high density—for example greater than 1.2 g/cm$^3$—organic foam, composite material, glass-fiber reinforced polyester, or a granular material, such as sand, plaster, shot, vermiculite, or glass beads, the granular material coated or not by a binder.

According to a structural characteristic of the invention, the bar or bars can be held integral with the support or case by means of at least two end shims pressing on an external surface of the bar or bars and made integral with the support or case by attachment means.

According to another embodiment, the explosive charge can incorporate at least two layers of explosives having different detonation rates, the detonation rate of the explosive in contact with the support being greater than that of the other explosives.

BRIEF DESCRIPTION OF THE DRAWINGS

The invention will be better understood after reading the following description of the different embodiments, said description being made with reference to the appended drawings, in which.

DETAILED DESCRIPTION OF PREFERRED EMBODIMENTS

Figure 1:
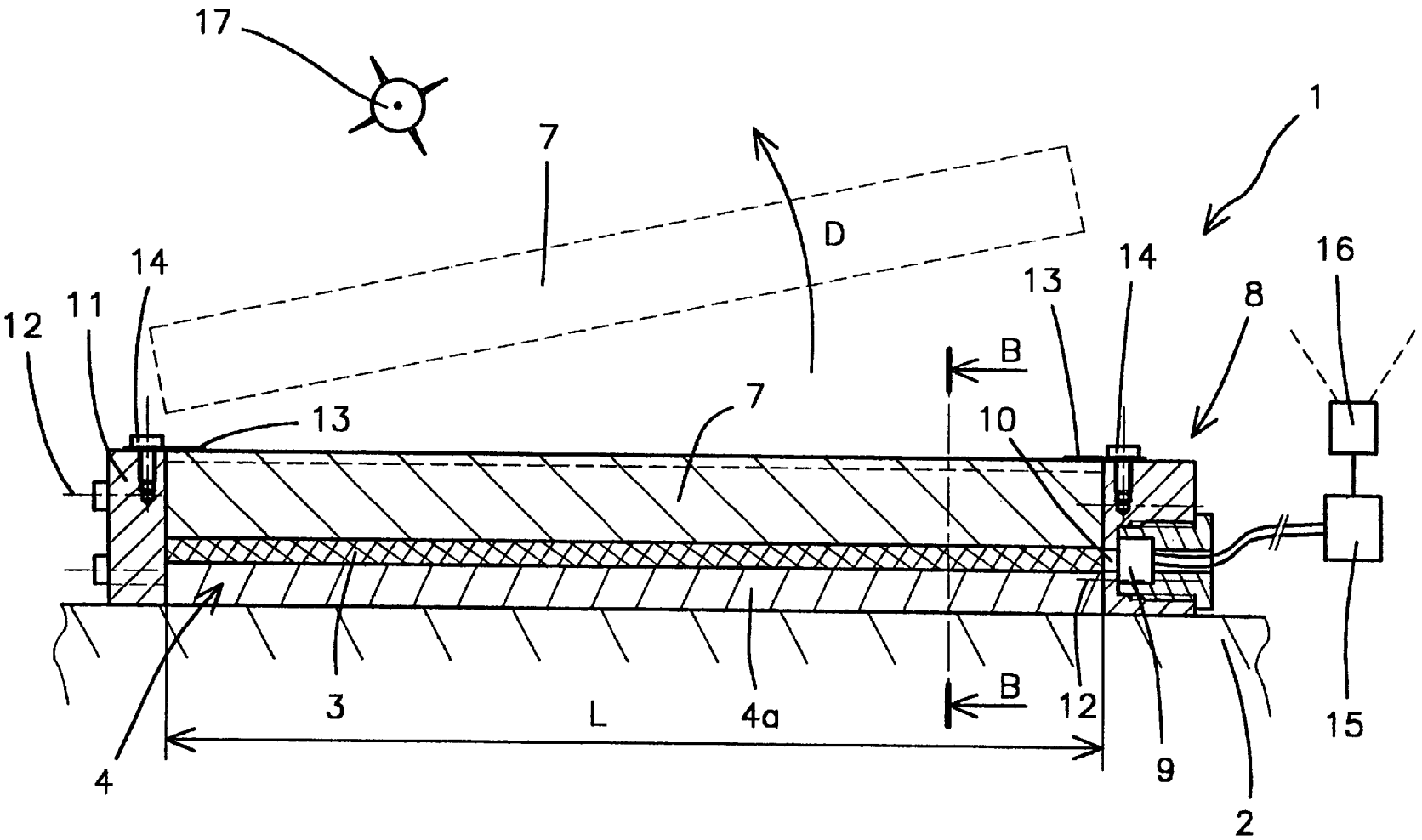
FIG. 1 is a longitudinal section view of a first embodiment of a protection device according to the invention, the section made along the plane traced as 1-1 in FIG. 2.
Figure 2:
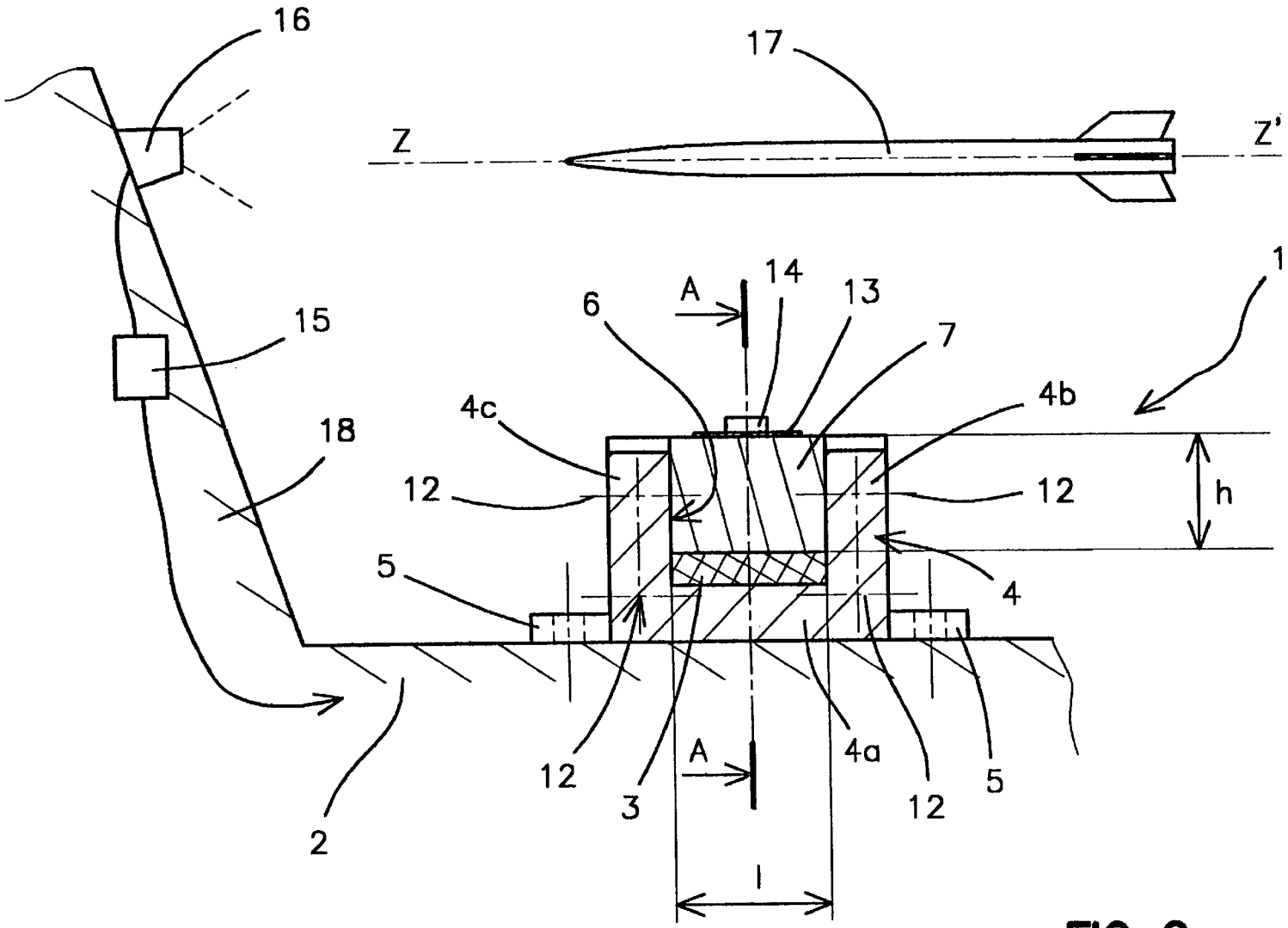
FIG. 2 is a cross section view of the first embodiment, the section made along the plane traced as 2-2 in FIG. 1.

With reference to FIGS. 1 and 2, a protection device 1 according to a first embodiment of the invention is fastened to a wall 2 of a vehicle (not shown in detail) using a suitable mode of attachment (for example flanges 5).

The device comprises a support 4 having a bottom plate 4*a* intended to be fastened to the vehicle and carrying the flanges 5, an explosive charge 3 is applied to the bottom plate 4*a* in the shape of a sheet of around 10 mm in thickness of explosive material (for example around 120 g of a composition associating pentol with an organic binder, for example the composition reference B2238 supplied by the Société Nationale des Poudres et Explosives—SNPE).

The support 4 incorporates a longitudinal cavity 6 that is delimited by two lateral cheeks 4*b*, 4*c*.

The cavity 6 receives the explosive charge 3 onto which a bar 7 is applied that is of substantially the same length and width as the charge 3.

The bar is in this case parallelepipedic and is of a maximum length L that is greater than or equal to 10 times its smallest crosswise dimension, here its height h ($L \geqq 10\ h$).

The bar will advantageously be given the following dimensions:

$$100\ \text{mm} < L < 400\ \text{mm};\ 3\ \text{mm} < h < 30\ \text{mm};\ 20 < W < 50\ \text{mm}.$$

The bar will be made, for example, of steel or titanium.

The explosive charge 3 is intended to be ignited by priming means 8 placed at one of the bar's 7 ends.

The priming means 8 comprise an electric squib 9 and may comprise a detonating relay 10 placed opposite one end of the explosive charge 3.

The cavity 6 of the support 4 is closed at one side by the priming means 8 and at the other by a closing plate 11. The plate 11 and priming means 8 are each fastened to the support 4 by four screws 12 of which only the heads and/or the axes are shown in the Figures.

The bar 7 is retained within the support 4 by means of two end shims 13 each formed of a steel plate of a thickness of 0.5 mm that presses on an external surface of the bar 7. Each shim 13 is fastened to the support 4 by a screw 14.

The squib 9 of the device 1 is connected by a wire to centralized control means 15 which is, in turn, connected to detection means 16, for example, radar or infrared detectors arranged on the vehicle.

The device operates as follows:

The wall 2 of the vehicle is, for example, a vehicle glacis wall. The bar 7 is placed at a vulnerable area of the vehicle (the frontal area) and such that the bar projects along a plane intersecting the potential directions of attack. Thus, the bar 7 is, in this case, substantially perpendicular to the rotational axis of the vehicle turret 18 (see the diagram in FIG. 2). A projectile 17, for example a fin-stabilized projectile or missile, thus follows a trajectory ZZ' bringing it to impact on the turret 18 after passing over the device 1.

The detection means 16, for example, integral with the turret 18, will detect the projectile 17 approaching from the direction ZZ'. The control means 15 will measure the approach velocity of the projectile 17 and compute the optimal time to trigger the operation of the device 1, that is the time when the projectile 17 is due to pass over the device 1 and intersect the bar's 7 plane of projection. The control means 15 then causes the explosive charge 3 to ignite.

Because of the positioning of the priming means 8 at one end of the bar, the detonation wave will sweep the explosive charge from one end to the other of the bar. This results in the gradual projection of the bar by lateral driving according to a phenomenon analogous to that encountered in shaped charges. The bar is thus projected along a direction D at a velocity of around 300 to 800 m/s, practically without strain or bending. The bar 7 makes an angle of around 3° with respect to the support 4 (lateral driving angle) (see the bar drawn in dashes in FIG. 1).

The retention shims 13 are retracted when the bar 7 is projected and they do not disturb its trajectory or geometry.

The bar 7 thus sweeps a substantially perpendicular plane to trajectory ZZ' of the projectile 17 impacting it, causing its fracture by shock or its destabilization by interference.

Because the bar is around 300 mm long, the projectile does not have to be located extremely accurately. It merely needs to be known that it will pass over the device. The device can be adapted by incorporating bars whose length will be thus selected according to the efficiency of the detection and location means.

The bar's velocity is mainly conditioned by the ratio between the explosive mass and that of the bar. However, the width of the bar, if it is over-reduced, risks causing a preponderance of the edge effects and a reduction in projection efficiency. Indeed, the detonation products expand more rapidly laterally, thereby reducing the transfer of energy.

In practical terms, the bar will be given a length L greater than or equal to 20 mm. The lateral cheeks 4*b*, 4*c* of the support allow the problem of this expansion to be partially overcome and also limit the lateral strain on the bar due to compressive stress.

It is also possible to provide a width for the layer of explosive material that is greater than that of the bar, thereby increasing the efficiency of the energetic transfer.

By way of a variant, an infrared detection barrier can be provided integral with and concretizing the support 4. This barrier will be arranged in series with the control means and will supply a confirmation of the presence of the projectile thereby causing the device to be activated. An entirely autonomous device can also be defined whose activation would be controlled by the passage of the projectile over the detection barrier.

Because the bar is primed from its end and because of the resulting reduced bending, the device's reliability is improved. Each point of the bar has substantially the same velocity, which is the projection velocity. The control means 15 are not, therefore, obliged to take dispersion or velocity deviations into account to activate firing.

By way of a variant, another geometric shape may be adopted for the bar, for example a cylindrical shape. In this case, suitable sealing means is provided so as to prevent the detonation products from expanding too quickly. The means used to fasten the device to the wall may naturally differ. The device may also be fastened onto an intermediate structure itself attached to the wall.

Figure 3:
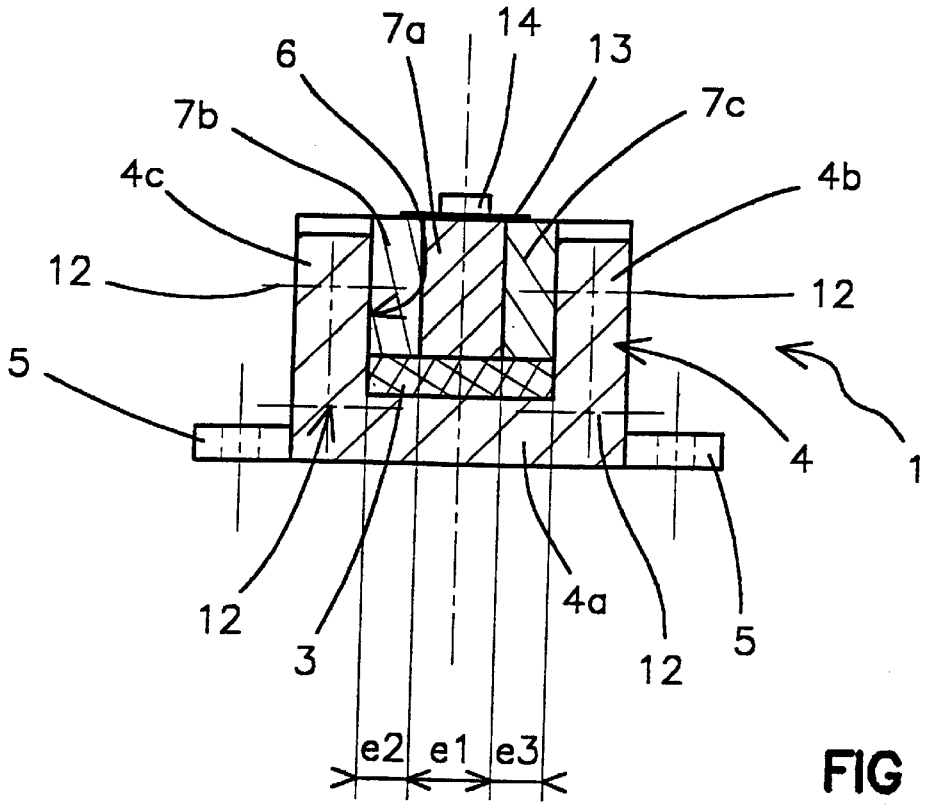
FIG. 3 is a cross section view of a second embodiment of the invention.

FIG. 3 is a cross section view of a second embodiment of the invention. This embodiment differs from the previous one in that the single bar 7 shown in FIG. 1 is replaced by three bars 7*a*, 7*b*, 7*c* placed in parallel to one another in the longitudinal cavity 6 delimited by the cheeks 4*a*, 4*b* of the support 4. The shims 13 are of a suitable width to retain the three bars.

The thickness e1 of the central bar 7*a* is greater than the thickness e2, e3 of each of the lateral bars. Moreover, in the embodiment shown here, e2=e3.

The presence of the lateral bars improves the efficiency of the device by reducing the edge effects for the projection of the central bar. Thus, the transfer of energy from the explosive to the central bar is at its optimum.

Because of the possible differences in mass, the velocity of the lateral bars can be modified with respect to that of the central bar.

Thus, if the three bars are of the same mass, the lateral bars will have a velocity that is less than that of the central bar because of the edge effects which reduce the efficiency of the energy transfer for the lateral bars.

If the mass of each of the lateral bars is less than that of the central bar, their velocity with respect to the previous case is increased and, according to the mass values adopted, the three bars can have the same velocity or different velocities.

Such an embodiment improves the efficiency of the device while ensuring the projection of several bars at identical, or possibly different, velocities (according to the values selected for the mass of each bar).

Multiple impacts are thus ensured, simultaneous or not, by this very compact device, on the incident projectile 17.

By way of a variant, it is naturally possible for the number of bars to be varied. The thicknesses (e1, e2, e3) of each may also be varied. A device incorporating two or three bars of the same thickness may thus be produced, as may a device having a thicker central bar and thinner lateral bars.

Lastly, different materials may also be selected for each bar. Such an arrangement will also allow the velocity of each bar to be varied, and will thus improve the overall efficiency of the device.

A central bar may, for example, be made of Titanium 10 mm thick, associated with two lateral bars each made of steel 10 mm thick.

Figure 4:
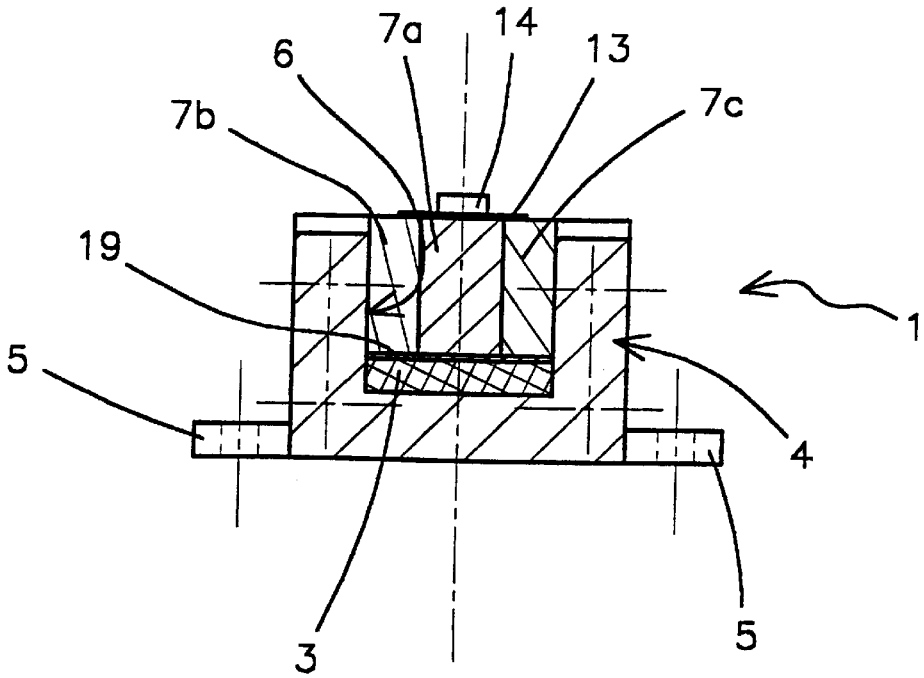
FIG. 4 is a cross section view of a third embodiment of the invention.

FIG. 4 shows a cross section view of a third embodiment of the invention that differs from the second embodiment in that it comprises a layer 19 placed between the bars 7*a*, 7*b*, 7*c* and the explosive charge 3.

The material of the intermediate layer 19 is selected with a specific sound impedance of the same order of magnitude as that of the bars. A metallic material will, for example, be selected.

The intermediate layer may comprise a sheet 0.5 to 1 mm thick made of the same material as one of the bars or else of a ductile metallic material, such as copper. Such a choice also ensures gas-tightness.

This layer allows the passage of the gases between the bars to be delayed and also ensures a regularization of the projection velocities.

By way of a variant, it is possible for the intermediate layer 19 to be given a different thickness at right angles with each bar opposite which it is placed. The projection velocities for each bar can thus be adjusted.

An intermediate layer can also be provided for a given bar that is of variable thickness from one edge to the other of the bar. Such an arrangement allows the projection direction of the bar in question to be varied.

Figure 5:
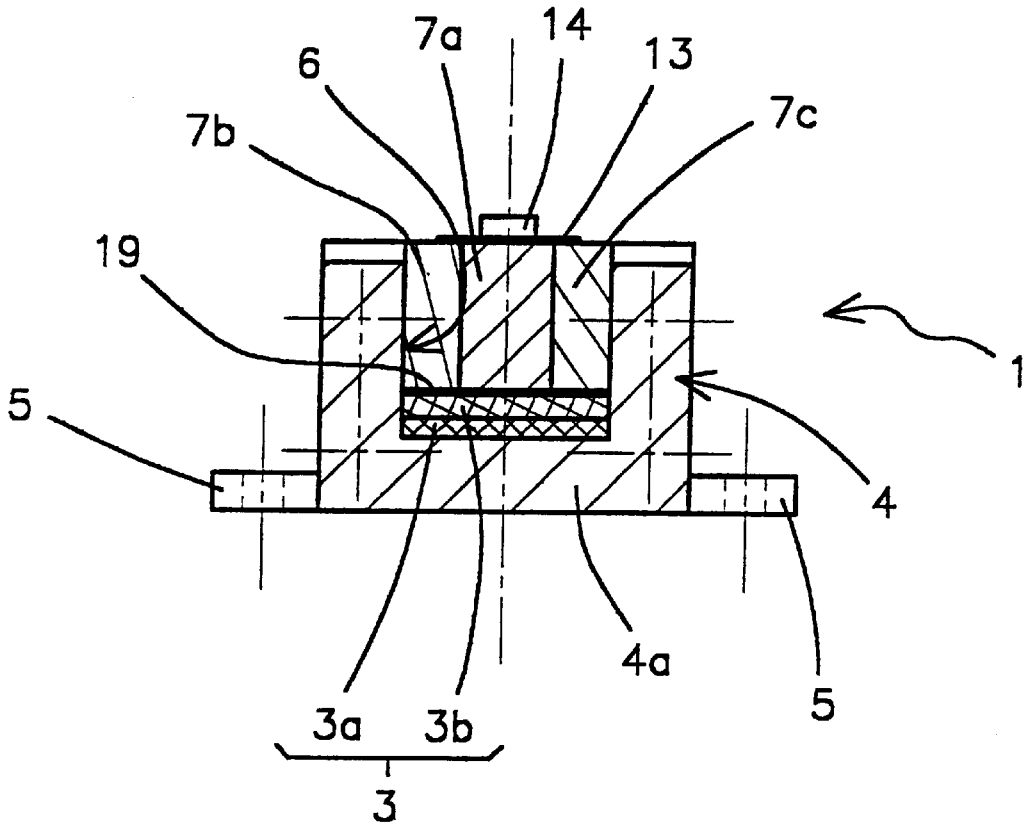
FIG. 5 is a cross section view of a fourth embodiment of the invention.

FIG. 5 is a cross section view of a fourth embodiment of the invention.

This embodiment differs from that in FIG. 4 in that the explosive charge 3 incorporates two layers of explosive 3*a*, 3*b* placed on top of one another.

Layer 3*b* in contact with the intermediate layer 19 is formed of an explosive having a detonation rate less than that of the explosive in layer 3*a* in contact with the support 4.

A layer 3*b* 5 mm thick can, for example, be made of the explosive known as Amatol (associating ammonium nitrate and TNT) (detonation rate: 3500 m/s) associated with a layer 3*a* 4 mm thick of an explosive referenced B2237 (marketed by the SNPE) (detonation rate: 7000 m/s).

Such an arrangement improves the efficiency of the device. Indeed, the detonation progresses more quickly in fast layer 3*a* than in slow layer 3*b* resulting in a planer priming of slow layer 3*b* by fast layer 3*a* and a dynamic containment of the detonation products leading to better energy transfer efficiency between the explosive and the bars.

Figure 6:
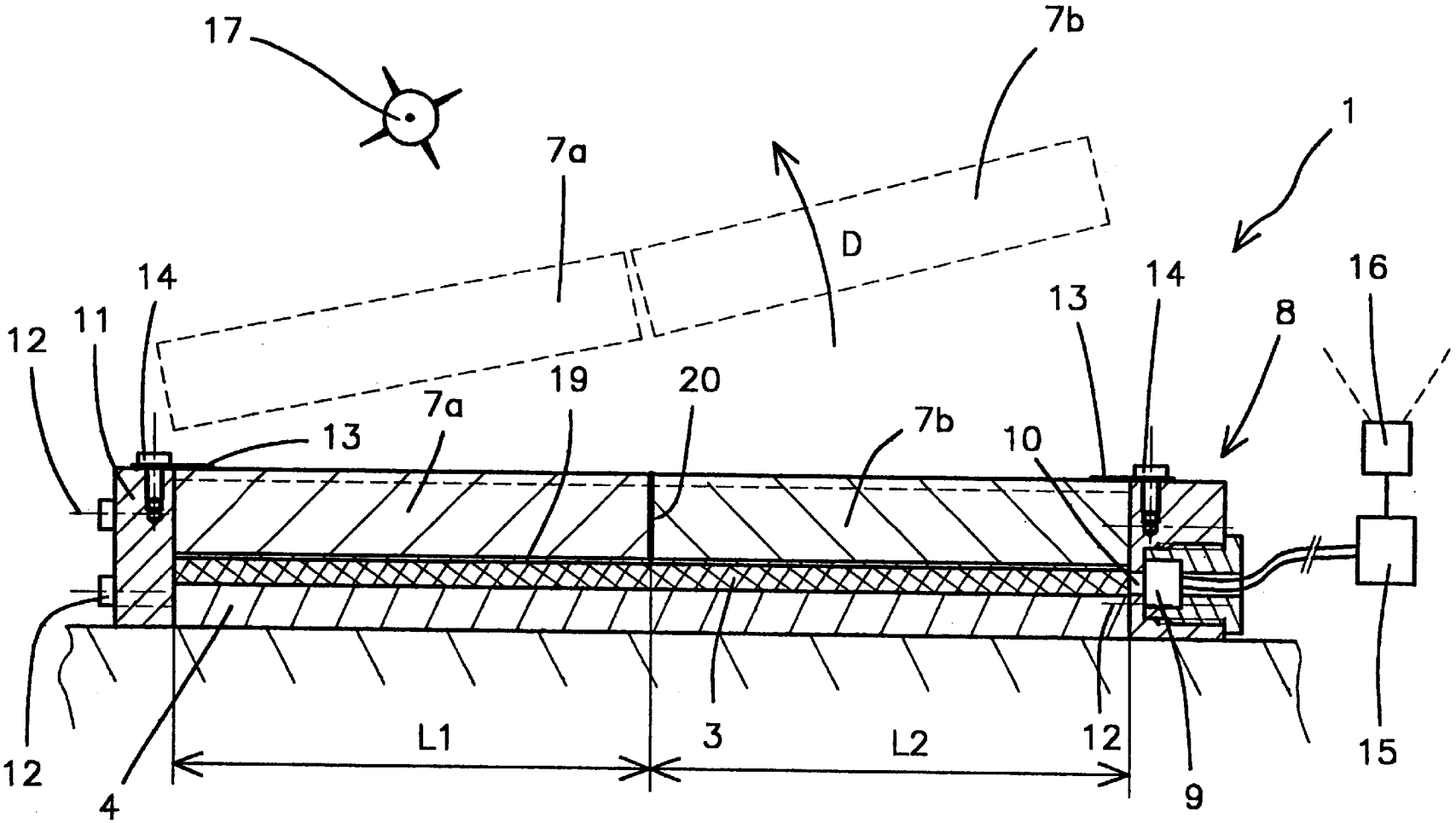
FIG. 6 is a cross section view of a fifth embodiment of the invention.

FIG. 6 shows a longitudinal section view of a device according to a fifth embodiment.

This embodiment differs from the one shown in FIG. 1 in that the bar 7 is replaced by two bars 7*a*, 7*b* placed one in the prolongation of the other in the cavity 6 of the support 4.

The two bars are in this case of an identical length L1=L2 and are made of the same material.

A layer 19 is placed between the bars 7*a*, 7*b* and the explosive charge 3. This arrangement provides gas-tightness for the detonation gases between the bars and allows the projection velocities to be regulated. Each bar is retained with respect to the support 4 by a shim 13 fastened by a screw 14.

The bars are joined with one another at their ends in mutual contact by a layer of adhesive 20.

Such an arrangement, as that described in reference to FIGS. 3 to 5, improves the efficiency of the device while ensuring the projection of several bars at identical velocities (if the masses of the bars are identical) and possibly different (if the masses are different).

A reduction in the strain on each bar is thereby ensured.

When the explosive charge 3 is ignited, the two bars 7*a* and 7*b* are projected substantially simultaneously following a direction D at a velocity of around 300 m/s. Each bar follows its own trajectory without strain or bending.

The bars may advantageously be made with different masses (for example, by acting on the materials or thickness of each bar). In this case, the velocity of each bar will differ.

By way of a variant, a number of bars over two may be provided. In this case, retention shims will be provided for the bars at a distance from ends 11, 8 of the device. For example, shims fastened by screws arranged in the lateral cheeks 4*b* and/or 4*c* of the support 4.

Naturally, it is also possible for this embodiment to be combined with the previous ones. For example, the explosive 3 may be replaced by two layers of explosive.

The explosive 3 may also be replaced by two longitudinally juxtaposed layers of explosive of different detonation rates. For example, a fast layer under the bar 7*b* followed by a slower layer:under bar 7*a*. The projection velocities of each bar may thus be varied without having to modify the geometry of the bars. It is also possible to provide both longitudinally juxtaposed and parallel bars.

Figure 7:
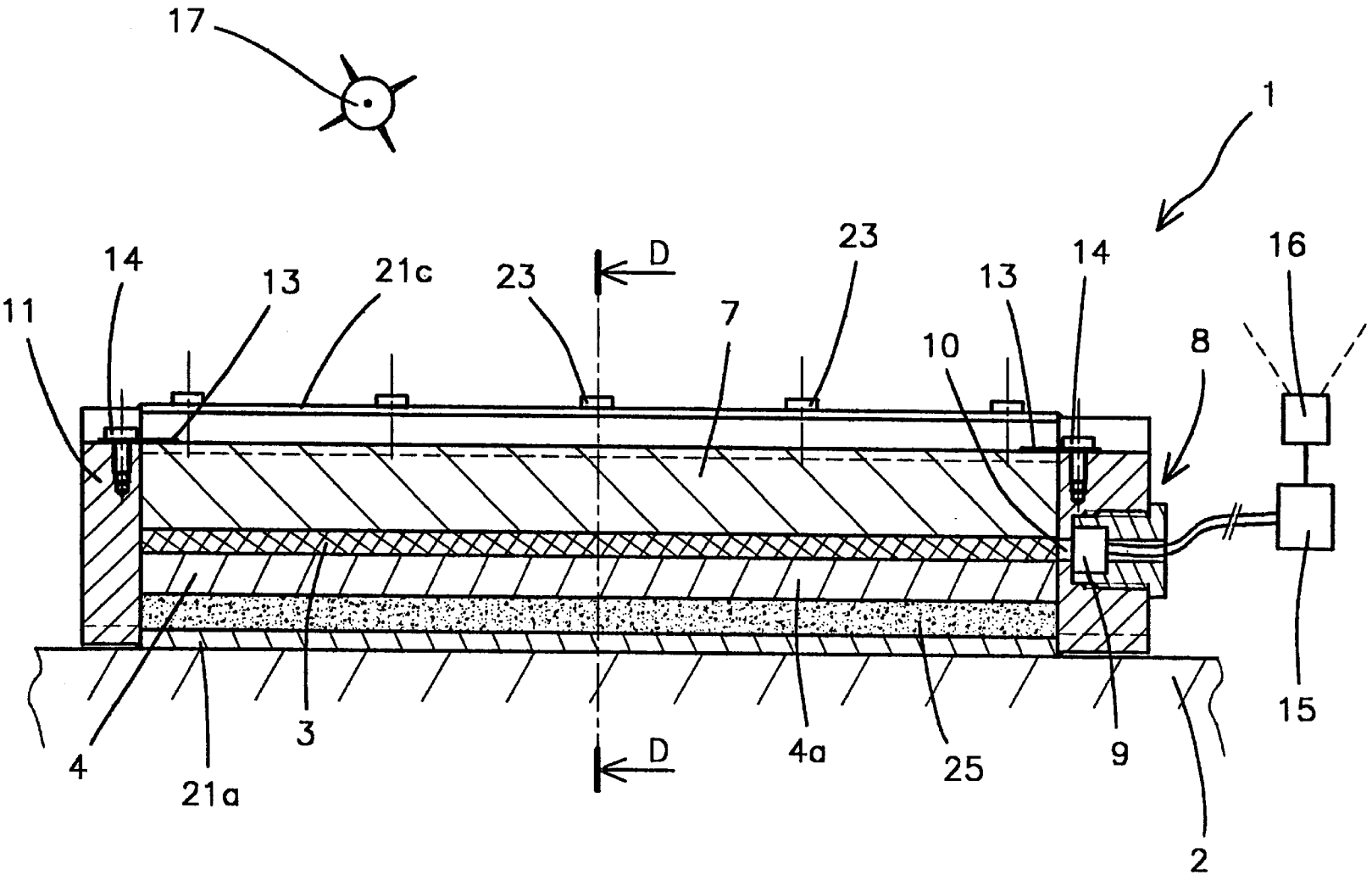
FIG. 7 is a longitudinal section view of a sixth embodiment of a protection device according to the invention, the section made along the plane traced as 7-7 in FIG. 8.
Figure 8:
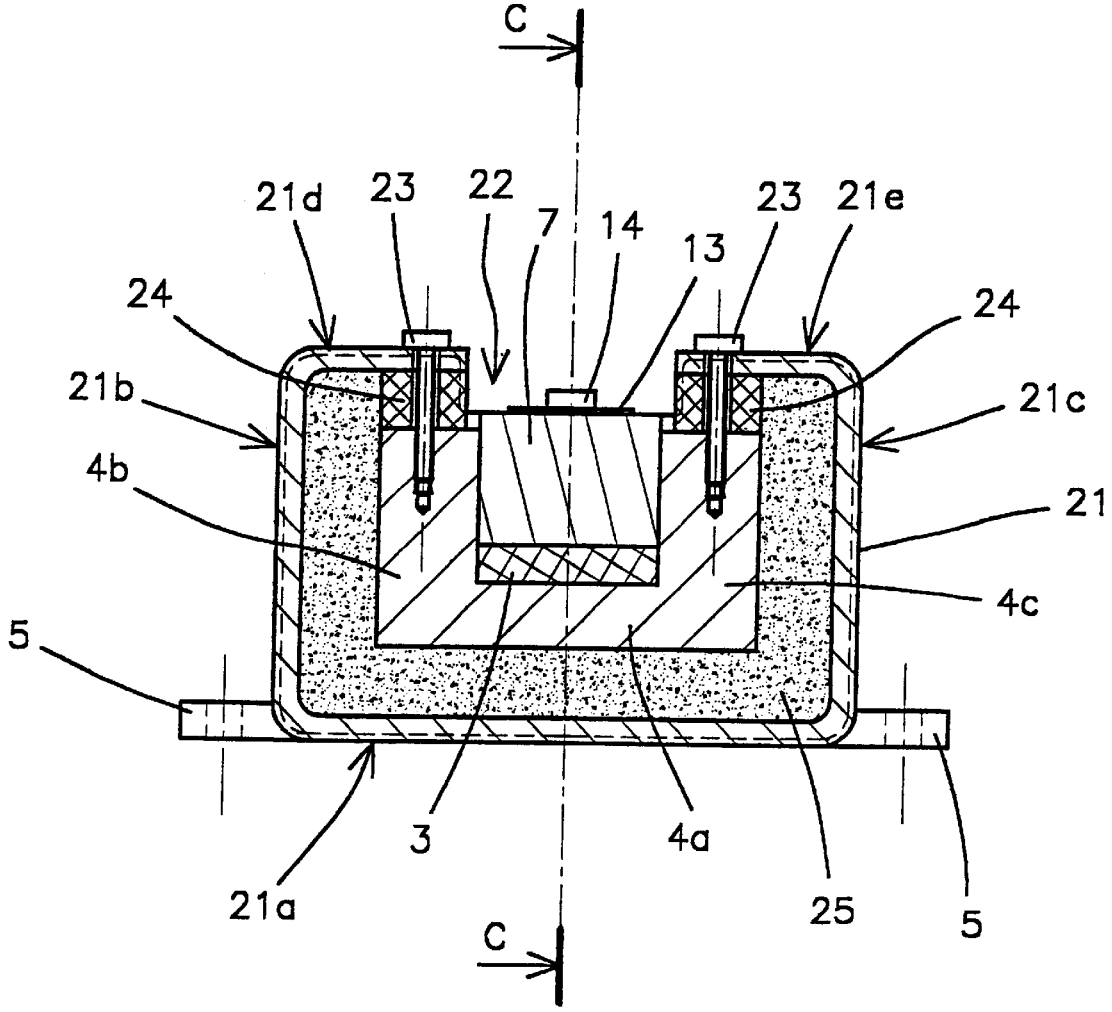
FIG. 8 is a cross section view of the sixth embodiment, the section being made along the plane traced as 8-8 in FIG. 7.

FIGS. 7 and 8 show a sixth embodiment of the invention.

According to this embodiment, the support 4 is placed in a case 21 made of a ductile material (that is to say having a breaking elongation over 20%). The case may, for example, be made of low carbon steel sheet 4 mm thick or else of a composite material.

The case comprises a bottom 21*a*, intended to come into contact with a wall 2 of the vehicle to be protected, and two lateral walls 21*b*, 21*c* enclosing the support 4 are folded so as to form two rims 21*d*, 21*e* substantially parallel to the bottom 21*a*.

Rims 21*d*, 21*e* delimit a longitudinal groove 22 opposite the bar 7.

The support 4 is made integral with the case 21 by screws 23 that press on the rims 21*d*, 21*e* and are engaged in female threadings made in the lateral cheeks 4*b*, 4*c* of the support 4. The screws 23 pass through two longitudinal strips 24 that allow the support 4 to be positioned with respect to the case 21. The strips 24 are, for example, made of a plastic material.

The closing plate 11 (which incorporates two fastening lugs 5) is welded (or bonded) at one end of the case 21. The plate's 11 profile is shown in dashes in FIG. 8. It has scalloping corresponding to the groove 22. It also carries, as in previous embodiments, the shim 13 allowing the bar 7 to be fastened to the support 4. The priming means 8 are fastened to the support 4 by screws (not shown) and to the case 21 by bonding or welding.

According to this particular embodiment, a layer 25 of shock-absorbing material is placed between the support 4 and the case 21.

The layer 25 partially surrounds the support 4 and is also situated between the case 21 and the two lateral cheeks 4*b*, 4*c* of the support 4.

The shock-absorbing material will be selected according to its capacities to absorb energy. A material having a high volume compressibility modulus will thus be used, that is one for which the ratio V/Vo of the volume V (after compression) over volume Vo (before compression) is between 0.1 and 0.6 when subjected to a dynamic pressure of around 30 GPa (GigaPascals).

The following may be selected as shock-absorbing materials: high density organic foam (for example, over 1.2 g/cm$^3$) or else a composite material allowing a high rate of volume deformation on the 0 to 30 GPa pressure variation range, such as a glass-fiber reinforced polyester or glass-fiber based filament winding.

An adaptive state equation material, such as a porous material, sand, shot, vermiculite, glass beads or plaster may also be used as a shock-absorbing material.

The granular materials may be coated with a binder, for example a plastic material such as an epoxy resin, or a mineral material, such as cement, or not.

The purpose of the layer of shock-absorbing material is to absorb the shocks transmitted to the vehicle. It also helps to prevent breakage of the support 4.

The case brakes the lateral cheeks of the support 4 during detonation. The collateral effects of the protection device are thereby reduced. The case also provides gas tightness for the device before activation. So as to improve such gas tightness, the groove 22 may be filled, in full or in part, with a layer of resin (not shown).

By way of a variant the case 21 and the layer of shock-absorbing material 25 may be replaced by a casing of a composite material, associating, for example, glass fibers in a resin matrix.

It is naturally possible to arrange a device according to one of the variants shown in FIGS. 2 to 6 (with several bars) in a case such as the one shown in FIGS. 7 and 8.

What is claimed is:

1. An active protection device for a wall against attack by a projectile and comprising:

at least one explosive charge able to project at least one metallic block in the direction of the projectile, wherein each block of the at least one block is in the shape of an elongated bar which has a maximal length greater than or equal to 10 times a smallest crosswise dimension, the explosive charge being positioned opposite a longitudinal surface of the bar; and a support having a bottom plate intended to be fastened to the wall and onto which the explosive charge is placed, wherein the support incorporates a longitudinal cavity delimited by two lateral checks and accommodating the explosive charge and the at least one bar.

2. The active protection device according to claim 1, wherein the explosive charge is ignited by priming means placed at one end of the at least one bar.

3. The active protection device according to claim 1, wherein the at least one bar is parallelepipedic.

4. The active protection device according to claim 2, wherein the at least one bar is parallelepipedic.

5. The active protection device according to claim 2, further comprising a support having a bottom plate intended to be fastened to the wall and onto which the explosive charge is placed.

6. The active protection device according to claim 1, comprising at least two bars placed substantially on a same longitudinal axis of one another, such that ends abut, in the support.

7. The active protection device according to claim 1, comprising at least two bars placed substantially in parallel to one another in the support.

8. The active protection device according to claim 7, comprising three bars placed substantially in parallel to one another in the support.

9. The active protection device according to claim 7, further comprising at least one intermediate layer of a material having a specific sound impedance of the same magnitude as that of the at least one bar, the intermediate layer being placed between the explosive charge and the at least one bar.

10. The active protection device according to claim 9, wherein the intermediate layer comprises a copper sheet of a thickness of 0.5 to 1 mm.

11. An active protection device for a wall against attack by a projectile and comprising:

at least one explosive charge able to project at least one metallic block in the direction of the projectile, wherein each block of the at least one block is in the shape of an elongated bar which has a maximal length greater than or equal to 10 times a smallest crosswise dimension, the explosive charge being positioned opposite a longitudinal surface of the bar;

a support having a bottom plate intended to be fastened to the wall and onto which the explosive charge is placed, and a case in which the support is placed.

12. The active protection device according to claim 11, further comprising a layer of shock-absorbing material between the support and the case.

13. The active protection device according to claim 12, wherein the support comprises a bottom and two lateral faces and the layer of shock-absorbing material is placed between the case and the bottom and the two lateral faces of the support.

14. The active protection device according to claim 12, wherein the shock-absorbing material comprises a material having a high volume compressibility modulus.

15. The active protection device according to claim 14, wherein the shock-absorbing material is selected from among the following materials: high density, for example greater than 1.2 g/cm$^3$, organic foam; composite material; glass-fiber reinforced polyester; or a granular material, such as sand, plaster, shot, vermiculite, or glass beads, the granular material coated or not by a binder.

16. The active protection device according to claim 6, further comprising at least two end shims, wherein the at least one bar is retained within the support or case by means of the at least two end shims pressing on an external surface of the at least one bar and attached to the support or case by attachment means.

17. An active protection device for a wall against attack by a projectile and comprising at least one explosive charge able to project at least one metallic block in the direction of the projectile, wherein each block of the at least one block of the at least one block is in the shape of an elongated bar which has a maximal length greater than or equal to 10 times a smallest crosswise dimension, the explosive charge being positioned opposite a longitudinal surface of the bar and the explosive charge incorporates at least two layers of explosives having different detonation rates, the detonation rate of a first explosive in contact with the support being greater than that of any other explosive.

* * * * *